US007625101B2

(12) United States Patent
Alessio

(10) Patent No.: US 7,625,101 B2
(45) **Date of Patent: *Dec. 1, 2009**

(54) LIGHTING DEVICE WITH ADJUSTABLE SPOTLIGHT BEAM

(75) Inventor: David J. Alessio, Amherst, OH (US)

(73) Assignee: Eveready Battery Co., Inc., St. Louis, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/752,322

(22) Filed: May 23, 2007

(65) Prior Publication Data

US 2007/0217198 A1 Sep. 20, 2007

Related U.S. Application Data

(63) Continuation of application No. 10/518,658, filed as application No. PCT/US03/19384 on Jun. 20, 2003, now Pat. No. 7,261,438.

(60) Provisional application No. 60/390,177, filed on Jun. 20, 2002.

(51) Int. Cl.
*F21S 8/00* (2006.01)

(52) U.S. Cl. ..... 362/268; 362/277; 362/307; 362/310; 362/319; 362/281

(58) Field of Classification Search ..... 362/268, 362/277, 307, 310, 311, 319, 281
See application file for complete search history.

(56) References Cited

U.S. PATENT DOCUMENTS

| | | | | |
|---|---|---|---|---|
| 3,116,022 | A | 12/1963 | Davis | |
| 3,896,466 | A | 7/1975 | Korpert | |
| 4,151,584 | A | 4/1979 | Labrum | |
| 4,519,020 | A | 5/1985 | Little | |
| 4,530,040 | A * | 7/1985 | Petterson | 362/188 |
| 4,807,097 | A * | 2/1989 | Gammache | 362/202 |
| 4,823,243 | A | 4/1989 | Weigert | |
| 5,042,048 | A | 8/1991 | Meyer | |
| 5,068,768 | A | 11/1991 | Kobayashi | |
| 5,184,249 | A * | 2/1993 | Dickman | 359/616 |
| 5,432,689 | A * | 7/1995 | Sharrah et al. | 362/183 |
| 5,584,568 | A | 12/1996 | Corbasson et al. | |
| 5,595,435 | A * | 1/1997 | Palmer et al. | 362/109 |
| 5,630,661 | A | 5/1997 | Fox | |
| 5,865,524 | A * | 2/1999 | Campman | 362/102 |
| 6,045,236 | A * | 4/2000 | Cheng et al. | 362/188 |
| 6,092,914 | A | 7/2000 | Esakoff et al. | |

(Continued)

FOREIGN PATENT DOCUMENTS

WO 01/98707 A1 12/2001

*Primary Examiner*—Sandra L O'Shea
*Assistant Examiner*—Mark Tsidulko
(74) *Attorney, Agent, or Firm*—Gregory J. Adams; Michael C. Pophal

(57) ABSTRACT

A lighting device has a light source, a light pipe, two convex magnifying lenses, and an adjusting mechanism for moving the two magnifying lenses relative to the light source. The light emitted from the light source is dispersed and directed into the light pipe by a reflector. The light pipe transfers collimated light through the first and second magnifier lenses which redirects the light to produce a circular spotlight beam having uniform intensity. The size of the spotlight beam is adjusted by an adjusting mechanism.

12 Claims, 4 Drawing Sheets

U.S. PATENT DOCUMENTS 6,174,071 B1 1/2001 Chan
6,702,452 B2 * 3/2004 Jigamian et al. ..... 362/205
6,746,124 B2 6/2004 Fischer et al.
6,837,596 B2 1/2005 Tanaka et al.
7,261,438 B2 * 8/2007 Alessio ..... 362/268

* cited by examiner

LIGHTING DEVICE WITH ADJUSTABLE SPOTLIGHT BEAM

CROSS-REFERENCE TO RELATED APPLICATION

This application claims the benefit of U.S. Provisional Application No. 60/390,177, filed Jun. 20, 2002, the entire disclosure of which is hereby incorporated herein by reference, PCT Application No. PCT/US 03/19384, filed Jun. 20, 2003, the entire disclosure of which is hereby incorporated by reference, and U.S. application Ser. No. 10/518,658, filed Dec. 16, 2004, the entire disclosure of which is hereby incorporated herein by reference.

BACKGROUND OF THE INVENTION

The present invention generally relates to lighting devices (e.g., flashlights) and, more particularly, to a portable lighting device having an adjustable and highly uniform spotlight beam.

Portable lighting devices, commonly known as flashlights or lanterns, have been commercially available for many years. A typical flashlight is generally made using a light source, such as an incandescent lamp, a reflector, a lens, and a power source, such as one or more dry cell alkaline batteries. The lens is generally disposed forward of the light source and reflector at the outlet. In some conventional flashlights, the lamp is axially movable towards or away from the reflector to adjust the spot size of the resultant light beam.

The spotlight beam produced by a conventional flashlight is typically non-uniform in intensity and geometry. While an adjustable lamp and reflector focus arrangement is well suited to adjust size of the resultant illuminating spotlight beam, the overall geometric shape and non-uniform light intensity generally remains. The poor uniformity of the light beam intensity and geometry detracts from the overall effectiveness and usefulness of the lighting device.

In view of these disadvantages, it would be desirable to have a portable lighting device that produces a spotlight beam of high uniform intensity and geometry. It is further desirable to provide for a lighting device having an adjustable size spotlight beam of high uniform intensity.

SUMMARY OF THE INVENTION

In accordance with one aspect of the present invention, a lighting device is provided having a light source for generating a light beam, a first magnifier lens disposed in a path of the light beam, and a second magnifier lens disposed in the path of the light beam. The lighting device includes an adjusting mechanism adjustable to move the first and second magnifier lenses relative to the light source to adjust the size of the light beam and provide a substantially uniform light beam.

The lighting device of this invention produces a highly uniform spotlight beam, which is much more useful than the light produced by conventional lamps.

These and other features, advantages and objects of the present invention will be further understood and appreciated by those skilled in the art by reference to the following specification, claims and appended drawings.

BRIEF DESCRIPTION OF THE DRAWING

The present invention will now be described, by way of example, with reference to the accompanying drawings, in which.

DETAILED DESCRIPTION OF THE PREFERRED EMBODIMENT

Figure 1:
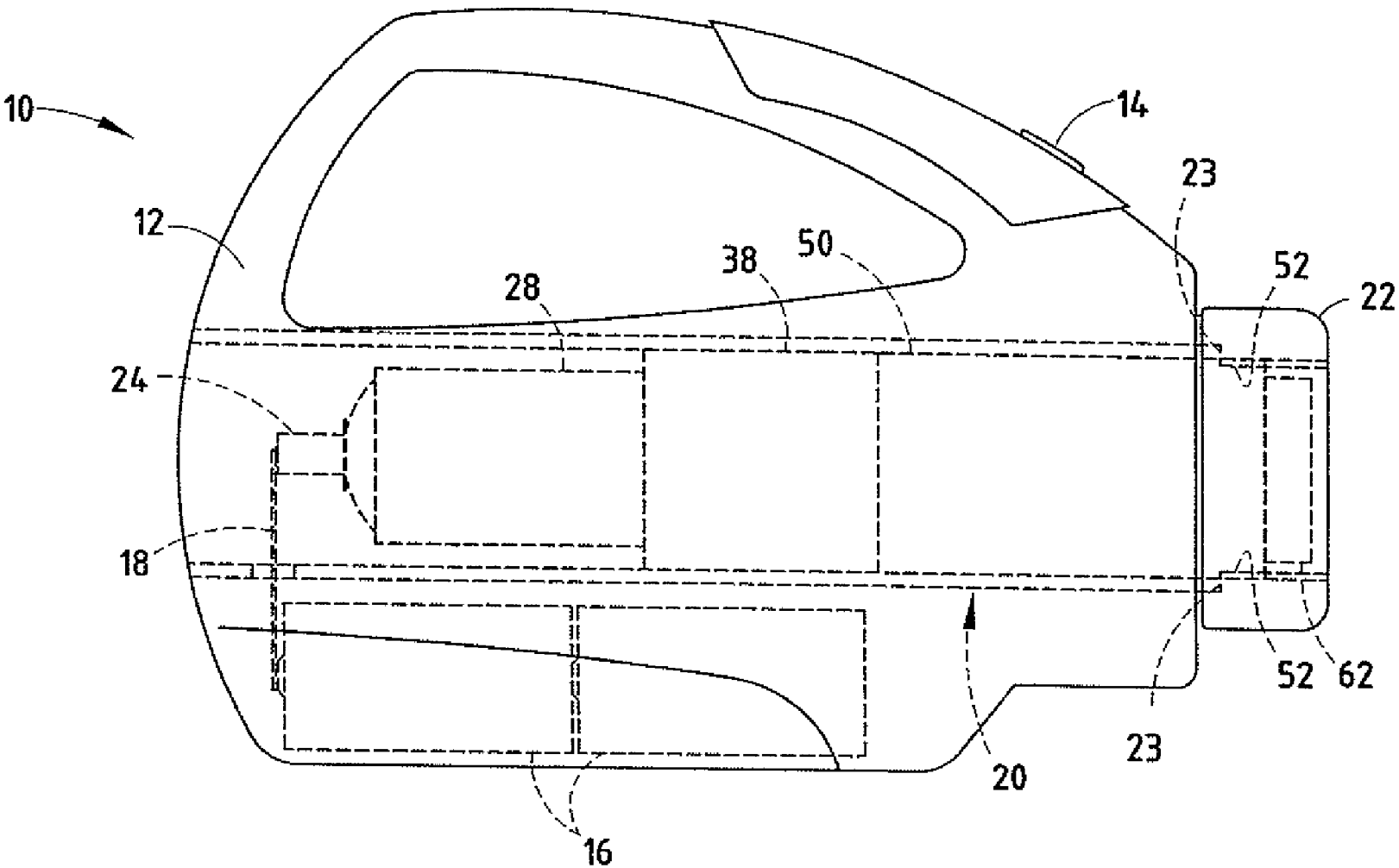
FIG. 1 is a side view of a lighting device (flashlight) having an adjustment mechanism according to one embodiment of the present invention.

Referring to FIG. 1, a portable lighting device 10 is shown having a light source and adjustment mechanism 20 according to the present invention. The light source and the adjustment mechanism 20 are disposed as an assembled unit within a housing 12 which is arranged to produce a spotlight beam radiating forward of lighting device 10. The adjustment mechanism 20 advantageously adjusts the size and intensity of the resultant spotlight beam and generates a high intensity and substantially uniform light beam. While the lighting device 10 is generally shown and described herein as a portable handheld flashlight, it should be appreciated that the lighting device 11 may be employed in any of a variety of lighting systems to provide light illumination to a target area.

The housing 12 of portable lighting device 10 is integrally formed to include a handle having a manually actuated light control switch 14 assembled thereto for controlling energization of lighting device 10. Disposed within a battery compartment in housing 12 are a plurality of energy storage batteries 16 (e.g., four D-size alkaline batteries) which serve as the electrical power source. The energy storage batteries 16 are electrically coupled to a high intensity lamp 24 via electrical circuitry 18 (e.g., electrical contact). The batteries 16 may include any number of one or more dry cell batteries or electrochemical cells. Examples of batteries or electrochemical cells include alkaline zinc/$MnO_2$, carbon/zinc, nickel metal hydride, nickel cadmium, and lithium based electrochemical cells. While batteries 16 are shown and described herein as the power source, the power source used in the present invention may employ any conventional power source, including an AC or DC power source.

The lighting device 10 is shown having a cylindrical adjusting cap 22 assembled at the front end of housing 12 and engaging the outer surface of rotatable barrel member 50 of the adjustment mechanism 20. The adjusting cap 22 and barrel member 50 are rotatable, clockwise and counterclockwise, about a central axis to adjust the size of the (diameter) and intensity of the resultant circular spotlight beam as described herein. While the adjustment mechanism 20 adjusts size and intensity of the light beam in response to manually-operated rotation of cylindrical cap 22, it should be appreciated that the adjustment mechanism 20 may otherwise be actuated manually or with the aid of a motorized assembly to adjust size and intensity of the spotlight beam.

The light generating and size adjustment portion of lighting device 10 including the light source and the adjustment mechanism 20 is illustrated in greater detail in FIGS. 2 through 4B. The light source is shown having a lamp 24 in the form of an incandescent lamp. The light source 24 may include any of a number of commercially available sources of light. For example, light source 24 may include one or more incandescent bulbs or one or more light emitting diodes (LEDs). The light source 24 may be in the form of a miniaturized incandescent vacuum krypton or halogen lamp.

The incandescent lamp 24 is shown assembled to a parabolic reflector 26. The lamp 24 extends through a central opening in reflector 26 and is positioned at the focal point of the reflector 26. The reflector 26 reflects a portion of the incident light forward from the rear side of lamp 24 in a forward direction. The reflector 26 may include any of a number of commercially available reflectors which may include reflectors having a concave reflective surface. The reflector 26 may be made of metal or non-metal, such as polymeric material (plastic) that has a metallized surface. According to one embodiment, the reflector 26 is a parabolic, fully-faceted reflector.

Assembled forward of reflector 26 and lamp 24 is a light pipe 28. Light pipe 28 is a generally cylindrical tube having an inner wall 30 for directing light rays emitted from the lamp 24 and reflector 26 in a substantially unidirectional path in the forward direction from lamp 24 and reflector 26 towards a pair of magnifier lenses as described herein. According to one embodiment, light pipe 28 is formed of a single tube having an aluminized inner reflective wall 30. The material used to form light pipe 28 may include any of a number of materials including aluminum and polymer.

Formed at the light outlet end of light pipe 28 is a reduced diameter lip 32. Lip 32 is angled radially inward to reduce the diameter of the outlet passage through which the light rays exit light pipe 28. Lip 32 may help to define a more uniform light beam having a uniform boundary defining the resultant spotlight beam.

Figure 2:
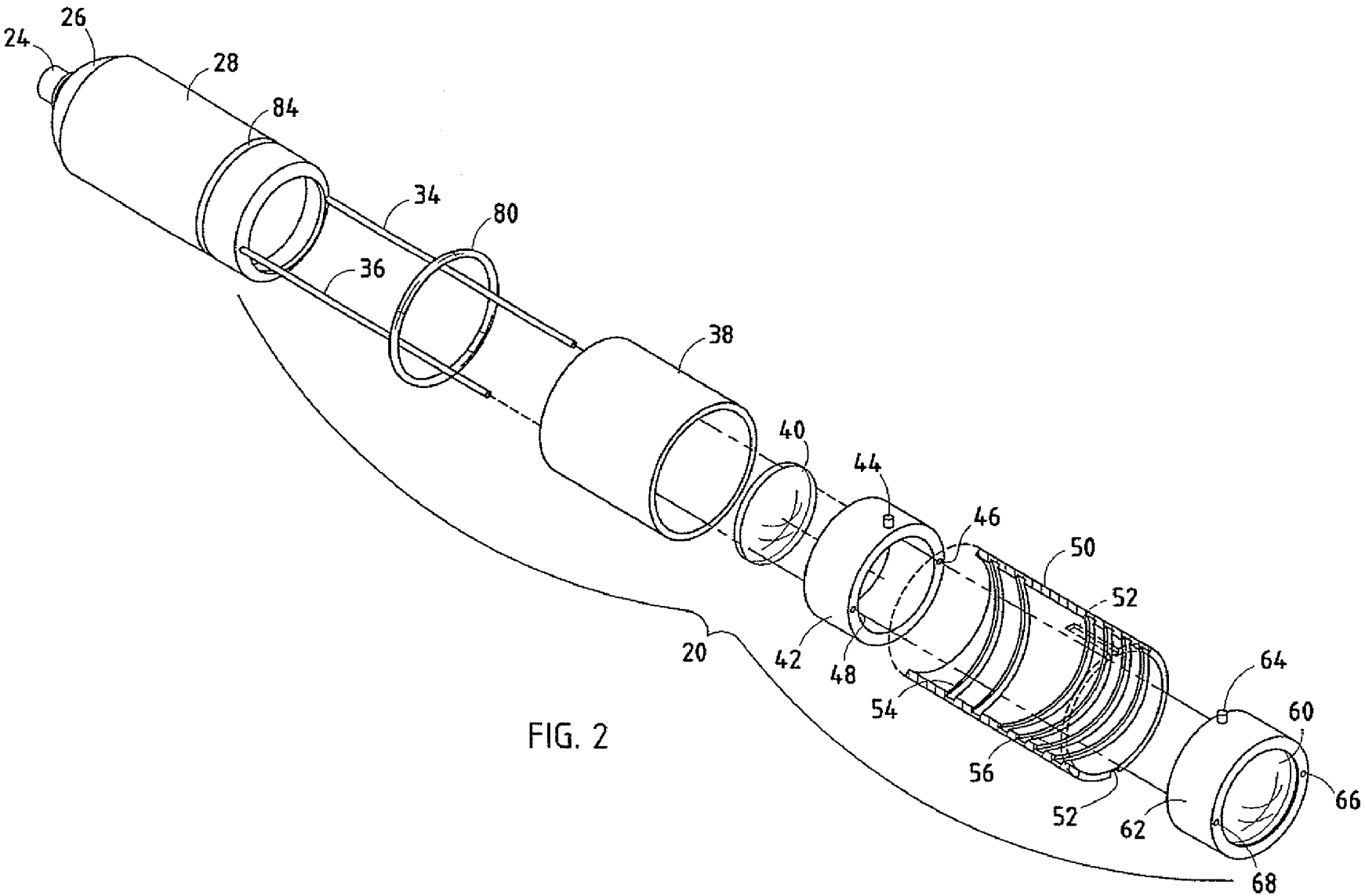
FIG. 2 is an exploded assembly view of the light source and adjustment mechanism employed in the lighting device in FIG. 2.

As best seen in FIG. 2, the adjustment mechanism 20 includes a pair of supporting rails 34 and 36, shown as parallel cylindrical rods, which are fixed at a first end within light pipe 28 and extend to an outer second end. Supporting rails 34 and 36 support the assembly of the adjustment mechanism 20. The first end of rails 34 and 36 may be glued or threaded within holes formed in light pipe 28, as shown. Assembled about supporting rails 34 and 36 is an optional outer tube 38 having an inner diameter greater than the outer diameter of the light pipe 28.

Inserted within outer tube 38 is an axially movable first sleeve member 42. First sleeve member 42 has a pair of cylindrical openings 46 and 48 for engaging rails 34 and 36, respectively. Accordingly, first sleeve member 42 slides on rails 34 and 36 substantially within outer tube 38. Supported within the first sleeve member 42 is a first magnifier lens 40 having at least one convex surface. The first magnifier lens 40 is press-fitted or adhered (e.g., glued) to the inner walls of first sleeve member 42, according to one embodiment. Alternately, first magnifier lens 40 may be otherwise attached to first sleeve member 42 by other known attachment means. Formed on the outer wall of first sleeve member 42 is an outwardly protruding first male member 44, shown herein as a pin. Pin 44 is configured to matingly engage a female receptacle (slot) which, in turn, drives the first sleeve member 42 axially in either direction along rails 34 and 36. The rails 34 and 36 allow axial movement of first sleeve member 42 and prevent rotation of the first sleeve member 42.

Also assembled to supporting rails 34 and 36 is a second sleeve member 62 having holes 66 and 68 for matingly engaging rails 34 and 36, respectively. Thus, second sleeve member 62 also slides on rails 34 and 36. The second sleeve member 62 likewise supports a second magnifier lens 60 having at least one convex surface. The second magnifier lens 60 may be press-fitted or adhered (glued) to the inner walls of second sleeve member 62, according to one embodiment. It should be appreciated that second magnifier lens 60 may be otherwise supported on second sleeve member 62 by other attachment means. Protruding from the outer wall of second sleeve member 62 is a second male member 64, shown herein as a pin. Pin 64 is configured to matingly engage a female receptacle (slot) which, in turn, drives the second sleeve member 62 axially along rails 34 and 36. The rails 34 and 36 allow axial movement of second sleeve member 62 and prevent rotation of second sleeve member 62.

The magnifier lenses 34 and 36 are light transparent optics magnifiers that redirect light transmitted through the lenses. The magnifier lenses 40 and 60 may each be configured as a double convex magnifier lens as shown, according to one embodiment. According to another embodiment, the magnifier lenses 40 and 60 may each include a plano convex magnifier lens. According to a further embodiment, one lens may be a double convex magnifier lens, and the other lens may be a plano convex magnifier lens. The magnifier lenses 40 and 60 each have at least one convex surface to redirect the light beam transmitted therethrough.

The magnifier lenses 40 and 60 can be made of any known transparent material, such as glass or a polymer (e.g., polycarbonate). The dimensions of the magnifier lenses 40 and 60 can vary depending upon the spotlight diameter desired. The first magnifier lenses 40 and 60 used in the present invention is commercially available from a variety of sources. The first magnifier lens 40 may be a polycarbonate double convex magnifier lens having the same specification as Model No. NT45-165, commercially available from Edmund Industrial Optics, according to one example. The aforementioned magnifier lens has a radius of curvature of 76.67 mm on both front and rear surfaces, a diameter of 30 mm, and an edge thickness of 2 mm, according to one example. The second magnifier lens 60 may be a polycarbonate double convex magnifier lens having a radius of curvature of 103 mm on the front and rear surfaces, a diameter of 30 mm, and an edge thickness of 2 mm, according to one example.

It should be appreciated that the various components, including the lamp 24, the reflector 26, the light pipe 28, and adjustment mechanism 20 are aligned upon a common axis. The length and diameter of the light pipe 28 and dimensions of the magnifier lenses 40 and 60 and distance between magnifier lenses 40 and 60 can be varied based on the size (diameter) of the final desired spotlight beam. The intensity of the resultant spotlight beam may also be affected by the dimensions of the light pipe 28, magnifier lenses 40 and 60, lamp 24 and reflector 26.

The adjustment mechanism 20 includes a barrel-shaped outer cylindrical member 50 that is rotatable about its central axis to move first and second sleeve members 42 and 62, and the corresponding magnifier lenses 40 and 60, axially toward and away from each other. The outer surface of barrel member 50 has longitudinal grooves 52 for engaging adjusting cap 22. The cylindrical barrel member 50 has the same diameter of outer tube 38 and abuts one end of outer tube 38. According to the embodiment shown, outer tube 38 and barrel member 50 are separate components that may be connected together. However, it should be appreciated that outer tube 38 and barrel member 50 could be formed as a single component.

The rotatable barrel member 50 includes an inner cylindrical wall having first and second female receptacles, shown as recessed slots 54 and 56, formed therein. The first slot 54 is spirally formed in a helix configuration having a first turn ratio of X turns/unit length. The second slot 56 is spirally formed in a helix configuration and having a second turn ratio Y turns/unit length, greater than the first turn ratio X. The second slot 56 is formed to spiral in the opposite direction of first slot 54. By forming slots 54 and 56 in opposite spiral directions, the first and second sleeve members 42 and 62 can be driven toward each other or away from each other simultaneously, by rotating barrel member 50.

Referring to FIGS. 3A through 4B, the first pin 44 of first sleeve member 42 is engaged within first slot 54 of barrel member 50. Similarly, the second pin 64 of second sleeve member 62 engages second slot 56 in barrel member 50. The first sleeve member 52 may be assembled to barrel member 50 by aligning first pin 44 with the outermost end of first slot 44 at one end of barrel member 50. Similarly, second sleeve member 62 may be inserted within barrel member 50 by aligning second pin 64 with the outer end of second slot 56 at the other end of barrel member 50.

Figure 3A:
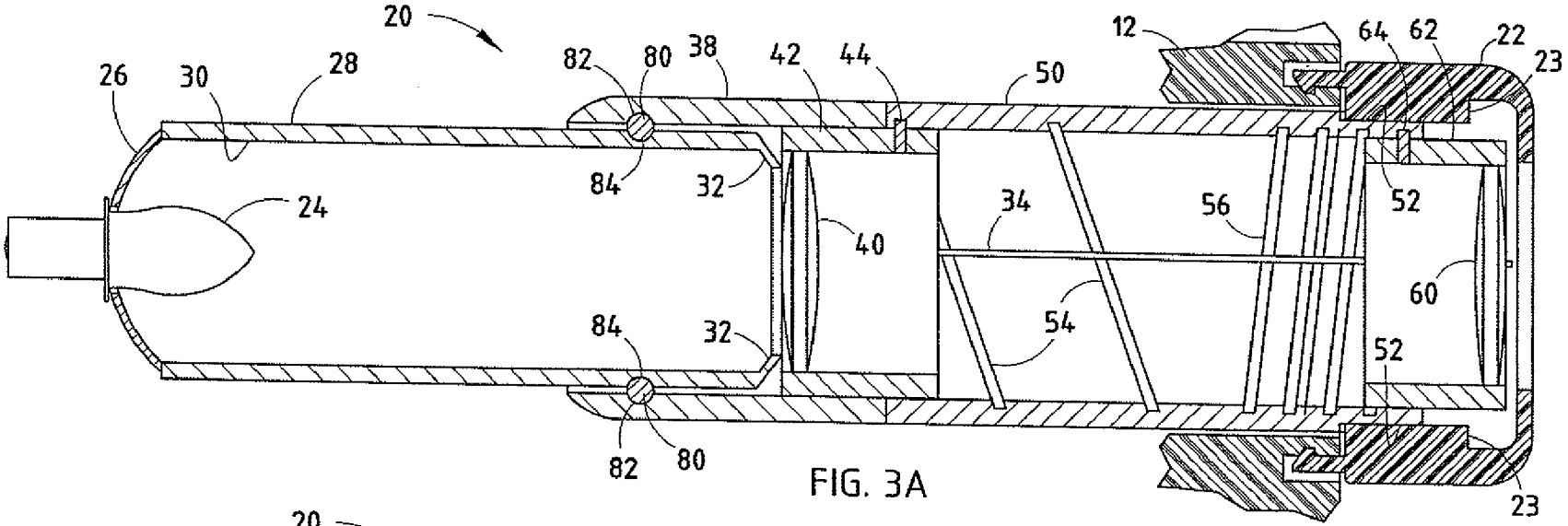
FIG. 3A is a cross-sectional view of a portion of the lighting device showing the light source and adjustment mechanism in a first position.
Figure 4A:
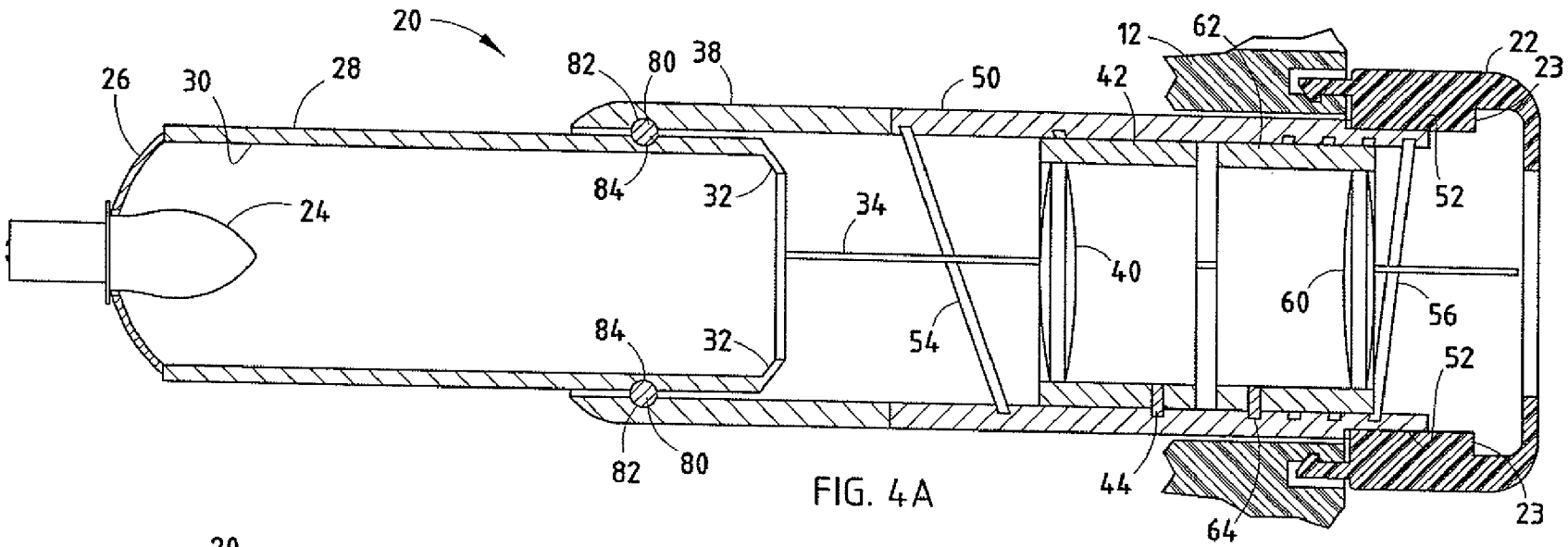
FIG. 4A is a cross-sectional view of the portion of the light source and adjustment mechanism shown in a second position.

With particular reference to FIGS. 3A and 4A, the adjusting cap 22 is further shown assembled to barrel member 50. The adjusting cap 22 is intended to be engagable by a user and rotated so as to rotate barrel member 50 to simultaneously move the magnifier lenses 40 and 60 axially towards or away from each other. The adjusting cap 22 is shown attached to barrel member 50 by ribs 23 of cap 22 engaging grooves 52 formed within the outer surface of barrel member 50. However, it should be appreciated that the adjusting cap 22 may otherwise be configured to enable a user of lighting device 10 to rotate the barrel member 50 so as to adjust positioning of magnifier lenses 40 and 60 to adjust the size and intensity of the spotlight beam, while maintaining a substantially uniform light beam.

Figure 3B:
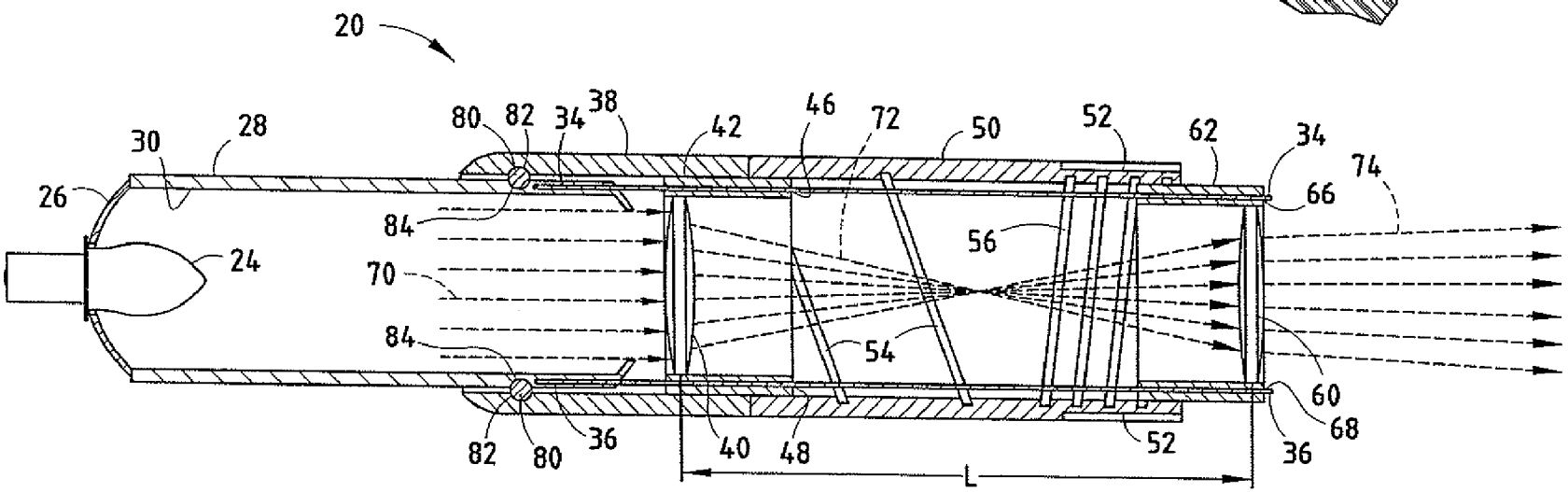
FIG. 3B is a cross-sectional view of the portion of the lighting device shown in FIG. 3A rotated ninety degrees (90°) and further illustrating the light beam produced in the first position.

Referring to FIGS. 3A and 3B, the light source and light beam adjustment portion of the light device 10 is illustrated in first and second positions for generating an adjustable size spotlight beam. The outer tube 38 is shown having a slot 82 formed on an inner wall for engaging a circular O-shaped ring 80. The circular ring 80, in turn, engages a slot 84 formed in the outer surface of light pipe 28. The ring 80 enables outer tube 38 to rotate relative to light pipe 28 while preventing axial movement of outer tube 38 relative to light pipe 28.

The first and second sleeve members 42 and 62 and corresponding magnifier lenses 40 and 60 are shown arranged in a first position in which lenses 40 and 60 are positioned furthest apart by distance L. As seen in FIG. 3B, in this first position, the light source 24 generates light rays 70 which travel forward within the inner wall 30 of light pipe 28, are refracted by first magnifier lens 40, and then converge, cross, and diverge as light rays 72 in the region between magnifier lenses 40 and 60. The diverging light rays 72 are refracted by second magnifier lens 60 and then are redirected into a substantially collimated beam 74 having a substantially uniform spot that may be directed onto a target area.

Figure 4B:
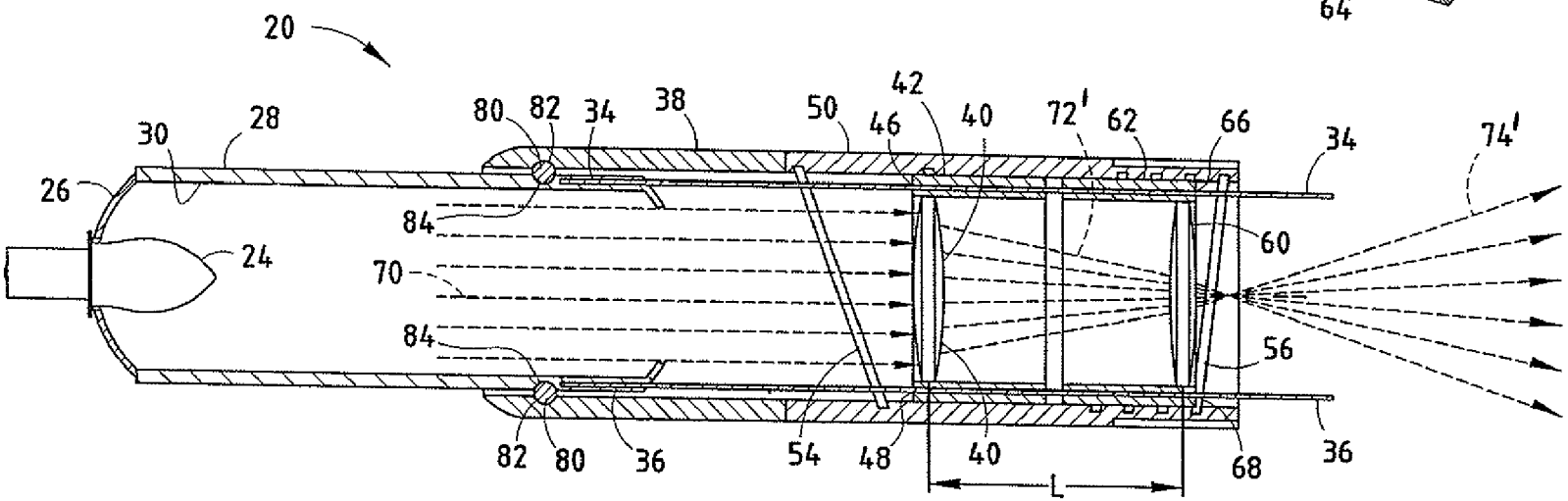
FIG. 4B is a cross-sectional view of the portion of the lighting device shown in FIG. 4A, rotated ninety degrees (90°) further illustrating the light beam produced in the second position.

The adjustment mechanism 20 is adjustable from the first position shown in FIGS. 3A and 3B to the second position shown in FIGS. 4A and 4B, including any intermediate positions, by rotating cap 22 and, thus, barrel member 50 to axially move the first and second sleeve members 42 and 62 and corresponding magnifier lenses 40 and 60 axially. In the second position, the separation distance L between magnifier lenses 40 and 60 is reduced to the closest position, and the resultant light beam 74' is expanded in size. Given a fixed light source intensity, the expanded size light beam results in a reduced intensity beam. The movement of the magnifier lenses 40 and 60 relative to each other is achieved by rotating focusing adjusting cap 22 which rotates barrel member 50. It should be appreciated that when actuating (rotating) the adjustment mechanism 20 of the present invention, the magnifier lenses 40 and 60 are moved axially relative to each other, and are both moved relative to the fixed position of the light source, namely the lamp 24.

Referring to FIG. 4B, the adjustment mechanism 20 is shown in the second position with the light source, namely lamp 24, producing the light rays 70 impinging on first magnifier lens 40. The first magnifier lens 40 causes light rays 70 to converge to form light rays 72'. Converging light rays 72' impinge on second magnifier lens 60. The second magnifier lens 60 causes light rays 72' to further converge to cross and then diverge to form a cone-shaped light beam 74' that produces a much wider and, hence, less intense spotlight beam when directed onto a distant target area.

Accordingly, the lighting device 10 employing the adjustment mechanism 20 of the present invention can be constructed and adjusted so that the diameter of the spotlight beam may be varied while maintaining a substantially uniform spotlight beam. By uniform intensity is meant that the intensity of the light producing the spotlight beam is substantially the same at all points of the spotlight beam. For example, the intensity of a light beam at the center is the same or substantially the same as the light intensity toward the edges of the spotlight beam. By rotating cap 22 and barrel member 50, a user can adjust the spotlight beam to the desired diameter size and light intensity. In doing so, magnifier lenses 40 and 60 are moved axially toward or away from each other, and are both moved axially relative to lamp 24.

While the relative movement of magnifier lenses 40 and 60 relative to each other and also relative to lamp 24 are shown and described herein in connection with a pin and slot arrangement actuated by a user rotating the barrel member 50, it should be appreciated that the magnifier lenses 40 and 60 may be moved relative to each other and relative to lamp 24 by other mechanical arrangements. It is conceivable that the spotlight adjustment of the present invention may be achieved by moving the light source, such as lamp 24, and one of or both of magnifier lenses 40 and 60, without departing from the teachings of the present invention. Further, it is also conceivable that the present invention could be automated to include a motor assembly that provides relative motion between the first and second magnifier lenses 40 and 60 and also between lamp 24 and magnifier lenses 40 and 60 to produce an adjustable highly uniform spotlight beam.

It will be understood by those who practice the invention and those skilled in the art, that various modifications and improvements may be made to the invention without departing from the spirit of the disclosed concept. The scope of protection afforded is to be determined by the claims and by the breadth of interpretation allowed by law.

The invention claimed is:

1. A lighting device comprising:

a light source for generating a light beam;

a first magnifier lens disposed in a path of the light beam;

a second magnifier lens disposed in the path of the light beam; and an adjusting mechanism to adjustably move the first and second magnifier lenses, the adjusting mechanism having a cylindrical barrel member, first and second receptacles, first and second male members, and a pair of sleeve members associated with the first and second receptacles, the first and second male members, and the first and second magnifier lenses.

2. The device of claim 1, wherein the first and second female receptacles are provided on one of the cylindrical barrel member and the pair of sleeve members, and the first and second male members are provided on the other of the cylindrical barrel member and the pair of sleeve members.

3. The device of claim 2, wherein the first and second male members travel within the first and second female receptacles so that when the cylindrical barrel member is rotated the pair of sleeve members move axially relative to each other.

4. The device of claim 1, further comprising a battery compartment electrically coupled to the light source.

5. The device of claim 4, wherein the batter compartment further comprises a plurality of energy storage batteries which serve as a power source.

6. The device of claim 5, wherein the plurality of energy storage batteries are lithium based electrochemical cells.

7. The device of claim 1, wherein the light source comprises one or more light emitting diodes.

8. The device of claim 1, wherein the light source comprises a halogen lamp.

9. A lighting device comprising:

a light source for generating a light beam;

a first magnifier lens disposed in a path of the light beam;

a second magnifier lens disposed in the path of the light beam;

an adjusting mechanism having a first female receptacle and a second female receptacle, the adjusting mechanism being adjustable to move the first and second magnifier lenses relative to the light source to adjust size of the light beam while maintaining a substantially uniform light beam;

a battery compartment electrically coupled to the light source:

wherein the first female receptacle comprises a slot spirally formed in a helix configuration and the second female receptacle comprises a slot spirally formed in a helix configuration; and wherein the second female receptacle has a greater turn ratio than the first female receptacle and the second female receptacle formed to spiral in an opposite direction of the first female receptacle.

10. The lighting device as defined in claim 9, wherein the light source comprises one or more light emitting diodes.

11. The lighting device as defined in claim 9, further comprising a housing including a handle that encloses the light source, the first magnifier lens, the second magnifier lens.

12. The lighting device as defined in claim 9, further comprising a housing and a cylindrical adjusting cap assembled at a front end of the housing, wherein the cylindrical adjusting cap engages an outer surface of the adjusting mechanism and the light source is assembled at a back end of the housing, which is at an opposite end of the housing relative to the front end of the housing.

* * * * *